United States Patent [19]

Spencer et al.

[11] Patent Number: 4,990,195

[45] Date of Patent: Feb. 5, 1991

[54] PROCESS FOR PRODUCING TUNGSTEN HEAVY ALLOYS

[75] Inventors: James R. Spencer, Sayre; James A. Mullendore, Towanda, both of Pa.

[73] Assignee: GTE Products Corporation, Stamford, Conn.

[21] Appl. No.: 293,030

[22] Filed: Jan. 3, 1989

[51] Int. Cl.[5] ..... B22F 1/00; B21B 3/00; C21D 8/02

[52] U.S. Cl. ..... 148/11.5 F; 72/202; 148/12.7 B; 420/430

[58] Field of Search ..... 148/11.5 F, 12.7 B; 420/430; 72/202

[56] References Cited

U.S. PATENT DOCUMENTS

| | | | |
|---|---|---|---|
| 3,633,667 | 5/1972 | Cheney et al. | 264/14 |
| 3,690,876 | 9/1972 | Smith et al. | 75/211 |
| 3,721,852 | 3/1973 | Chiola et al. | 174/50.64 |
| 3,723,792 | 3/1973 | Chiola et al. | 313/318 |
| 3,785,019 | 1/1974 | Chiola et al. | 29/25.13 |
| 3,798,058 | 3/1974 | Chiola et al. | 117/201 |
| 3,881,911 | 5/1975 | Cheney et al. | 75/0.5 BB |
| 3,888,636 | 6/1975 | Sczerzenie et al. | 420/430 |
| 4,307,966 | 12/1981 | Spencer et al. | 400/124 |
| 4,322,248 | 3/1982 | Patrician et al. | 75/245 |
| 4,458,599 | 7/1984 | Mullendore et al. | 102/517 |
| 4,744,944 | 5/1988 | Spencer et al. | 419/23 |
| 4,749,410 | 6/1988 | Mullendore et al. | 75/248 |
| 4,768,365 | 9/1988 | Spencer et al. | 72/202 |
| 4,777,015 | 10/1988 | Kemp, Jr. et al. | 419/32 |
| 4,784,690 | 11/1988 | Mullendore | 75/248 |
| 4,801,330 | 1/1989 | Bose et al. | 420/430 |
| 4,832,907 | 5/1989 | Johnson et al. | 419/36 |
| 4,836,108 | 6/1989 | Kegel et al. | 102/306 |
| 4,847,045 | 7/1989 | Kemp, Jr. et al. | 419/36 |
| 4,885,031 | 12/1989 | Spencer et al. | 75/248 |

*Primary Examiner*—Upendra Roy
*Attorney, Agent, or Firm*—Donald R. Castle

[57] ABSTRACT

A consolidated tungsten alloy body consisting essentially of from about 60% to about 98% by weight of tungsten, balance, nickel and iron, containing a continuous phase of tungsten and a discontinuous phase of grains of a tungsten, nickel and iron alloy having an aspect ratio of at least 4:1 relatively uniformly distributed throughout the continuous phase and wherein said body has a recrystallization temperature of from about 1000° C. to about 1200° C. A process for producing the consolidated bodies comprises working and annealing at controlled temperatures to achieve the desired properties. The working temperatures are from about 700° C. to about 900° C. and the annealing temperature is preferably 1200° C.

2 Claims, 1 Drawing Sheet

90W - 7Ni - 3Fe Alloy

PROCESS FOR PRODUCING TUNGSTEN HEAVY ALLOYS

FIELD OF THE INVENTION

This invention relates to tungsten heavy alloys. More particularly it relates to tungsten heavy alloys with an improved grain structure and a process for achieving same.

BACKGROUND

The composition of tungsten heavy alloys are known in the art have a tungsten content of from about 88% to about 98% by weight, balance nickel and iron. In conventional prior processes used to produce the preferred tungsten heavy alloys resulted in materials having spherical tungsten grains of at least 30 micrometers in diameter as a discontinuous phase and surrounded by a continuous matrix phase of nickel, iron and tungsten. When tungsten heavy alloys are used as kinetic energy penetrators they are generally mechanically worked to increase the hardness of the penetrator. With conventional working methods the reduction in area is generally in the 7% to 25% range. Working beyond 25% resulfed in the generation of defects at the matrix tungsten interface. The aspect ratio of the tungsten grains in the material worked in this manner is generally no greater the about 1:2.

It is believed, therefore, that a tungsten heavy alloy material containing from about 60% to about 98% tungsten and having improved properties, in particular, a higher recrystallization temperature, that is above about 1000° C., and a unique microstructure, namely a continuous phase of tungsten and a discontinuous phase of a tungsten-nickel-iron alloy having grains with an aspect ratio greater than about 4:1 relatively uniformly dispersed thoughout the continuous tungsten phase and wherein the nickel to iron weight ratio in the tungsten heavy alloy is from about 6:4 to about 9:1, which alloy has a high impact strength and improved machinability would be an advancement in the art.

SUMMARY OF THE INVENTION

In accordance with one aspect of this invention there is provided a relatively ductile consolidated tungsten heavy alloy body consisting essentially of from about 60% to about 98% by weight of tungsten, balance nickel and iron in a weight ratio of from about 6:4 to about 9:1 containing a continuous tungsten phase and a discontinuous phase of grains of an alloy of tungsten, nickel and iron having an aspect ratio of at least 4:1 wherein said grains are relatively uniformly distributed throughout the continuous phase and wherein the body has a recrystallization temperature of from about 1000° C. to about 1200° C.

In accordance with another aspect of this invention, there is provided a process for producing consolidated bodies having these unique characteristics which process comprises forming a bar of a tungsten heavy alloy consisting essentially of from about 60% to about 98% by weight of tungsten, balance nickel and iron thereafter working the bar to achieve a total reduction of about 20% by using a series of passes to achieve up to about a 5% reduction in cross-sectional area per pass at a first temperature range of from about 700° C. to about 900° C., annealing the reduced bar at a second temperature of from about 1200° C. to about 1400° C. for at least about 2 hours, working the annealed bar at the first temperature range using a series of passes to achieve from about 5% to about 20% reduction per pass to achieve about an additional 30% reduction in cross-sectional area and optionally repeating steps c and d until at least an 80% reduction is achieved. Thereafter, the material is treated by either heat treating or annealing, working and age hardening to achieve the desired ductility. To achieve the desired ductility the reduced size material is either heat treated at a temperature of from about 700° C. to about 1200° C. for about 2 to about 4 hours or it can be annealed at about 1200° C. to about 1400° C. for about 2 hours, worked at between about 20° C. and about 300° C. to achieve an additional reduction of from about 7% to about 25% and then heating the resulting reduced material to about 400° C. to about 600° C. for at least about 2 hours.

BRIEF DESCRIPTION OF THE DRAWINGS

The drawings are photomicrographs showing the microstructures of two typical materials.

DETAILED DESCRIPTION OF THE PREFERRED EMBODIMENTS

For a better understanding of the present invention, together with other and further objects, advantages, and capabilities thereof, reference is made to the following disclosure and appended claims in connection with the above described description of some of the aspects of the invention.

Figure 1:
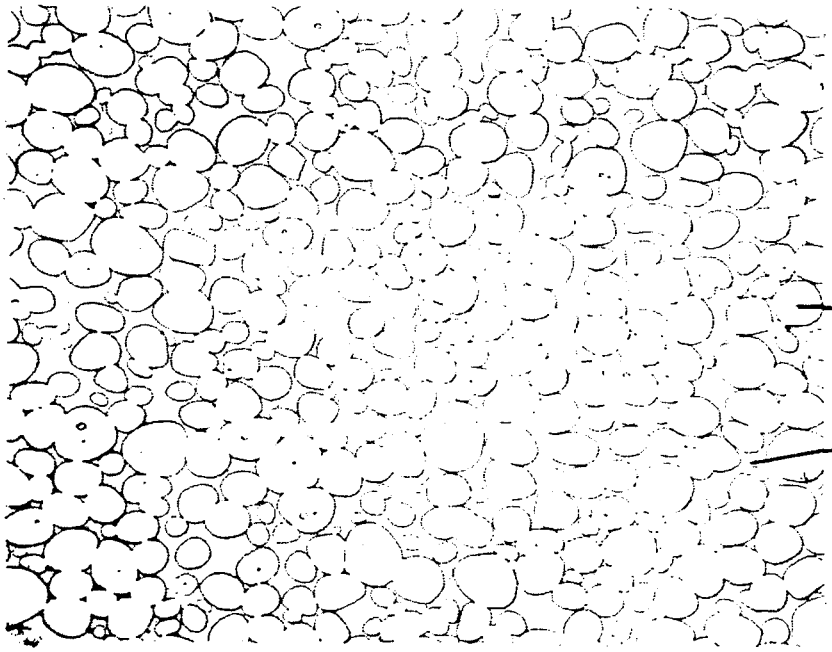
FIG. 1 shows the microstructure of a prior art 90W-7Ni-3Fe alloy which has been liquid phase sintered.

Tungsten heavy alloys are normally produced by liquid phase sintering and have tungsten grains of about 30 micrometers in size uniformly distributed throughout a matrix of an alloy of tungsten-nickel-iron. The microstructure of a typical tungsten heavy alloy material produced by prior art methods is shown in FIG. 1.

To produce grains of a high aspect ratio, which is believed to promote penetration performance of kinetic penetrators, tandem rolling with a Kocks mill or hydrostatic extrusion can be used. Such methods can enable over 80% reductions and aspects ratios of over 4. Although tandem rolling with a Kocks mill or hydrostatic extrusion can be used to achieve 80% reductions in area, these methods lower the recrystallization temperatures of the tungsten grains to as low as 800° C. and recrystallization of these grains causes a dramatic loss in mechanical properties. Being limited to below 800° C. severely restricts the heat treatments that can be used to recover ductility in the matrix phase of the tungsten heavy alloys. Ductility is an important property in penetrators.

In the practice of this invention the tungsten heavy alloy bars containing from about 60% to about 98% by weight of tungsten balance nickel and iron in a weight ratio of from about 6:4 to about 9:1 that are solid state sintered are worked by rolling or swaging at a first temperature range of from about 700° C. to about 900° C. with intermediate anneals at a second temperature range of from about 1200° C. to about 1400° C. Working below about 700° C. results in age hardening effects when reheated. Working at about 900° C. results in the development of defects at the tungsten matrix interface.

The bars are worked using passes to achieve up to about a 5% reduction in cross sectional area per pass. Since a reduction of 5% per pass can be utilized, it is the preferred amount of reduction per pass. In general, it is preferred to use the largest reduction per pass that one can obtain and still obtain the desired characteristics in the bar. During the annealing step a vacuum or a nitrogen atmosphere is used. After working the first 20% bars are given a 2 to 3 hour anneal at about 1200° C. to about 1400° C. and then are worked an additional 30% using 5% to about 20% reduction per pass. This anneal and reduction sequence can be repeated as many times as required to reach the desired diameter. Preferably a reduction of at least about 80% is achieved. Once at the desired size, the bar can be heat treated at a temperature of from about 700° C. to about 1200° C. for about 2 to about 4 hours to develop the desired ductility in the matrix. Alternatively, the bar can be annealed again at 1200° C. and then worked at 20° C. to 300° C. to 7% to about a 25% reduction in area. The bars can then be hardened to the desired level by aging them at temperatures of 400° C. to 600° C. for at least about 2 hours.

Figure 2:
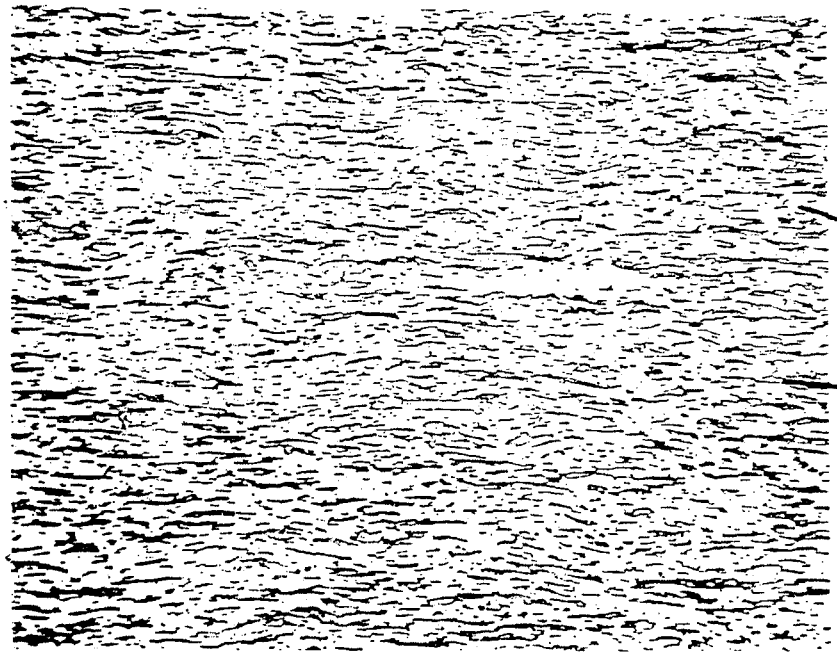
FIG. 2 shows the microstructure of a 90W-7Ni-3Fe alloy of this invention worked and annealed in accordance with the process of this invention.

The microstructure of a 90W-7Ni-3Fe alloy of this invention is shown in the photomicrograph labeled FIG. 2 of the drawings. As can be seen there is a continuous phase of tungsten and discontinuous phase of grains of an alloy of tungsten-nickel-iron. The aspect ratio of the grains of the alloy is at least 4:1 with many grains having an aspect ratio of as high as 30:1.

The alloys of this invention are relatively ductile, that is the ductility of the alloys of this invention is equal to or exceeds the ductility of the prior art alloys which had tungsten grains of at least about 30 micrometers surrounded by a continuous phase of tungsten, nickel and iron.

The alloys thus produced have unique characteristics in that they have a recrystallization temperature of from about 1000° C. to about 1200° C. and have a discontinuous phase of grains of an alloy of tungsten, nickel and iron having an aspect ratio of at least about 4:1 and a thickness of less than about 3 micrometers, as measured in the transverse plane, and a continuous phase of tungsten wherein the nickel and iron are in a weight ratio of from about 6:4 to about 9:1, with from about 7:3 to about 8:2 being preferred. The tungsten content of the alloys range from about 60% to about 98% by weight of tungsten, with from about 80% to about 96% being preferred.

While there has been shown and described what are considered the preferred embodiments of the invention, it will be obvious to those skilled in the art that various changes and modifications may be made therein without departing from the scope of the invention as defined by the appended claims.

What is claimed:

1. A process for producing consolidated tungsten heavy alloy bodies which process comprises:

(a) forming a bar of a tungsten heavy alloy consisting essentially of from about 60% to about 9% by weight of tungsten, balance nickel and iron in a weight ratio of nickel to iron of from about 6: to about 9:1, by sintering at a temperature below the melting point of said iron an nickel,;

(b) working the bar at a temperature of between about 700° C. and about 900° C. using a series of passes to achieve up to about a 5% reduction in cross-sectional area per pass to produce an initially reduced bar having a reduction in cross sectional area of about 20%;

(c) annealing the reduced bar at temperature of from about 1200° C. to about 1400° C. for at least about 2 hours;

(d) working the annealed bar at about 700° C. to about 900° C. using a series of passes to achieve from about 5% to about 20% reduction per pass until about an additional 30% reduction in cross-sectional area is achieved;

(e) repeating steps (c) and (d) in sequence as necessary to achieve a desired reduction;

(f) annealing said bar from step e at a temperature of about 1200° C. to about 1400° C.;

(g) working said bar from step (f) at about 20° C. to about 300° C. to achieve about a 7% to about a 25% reduction in area, and (h) age hardening said bar at about 400° C. to about 600° C.

2. A process according to claim 1 wherein steps c and d are repeated until at least an 80% overall reduction i n cross-sectional area is achieved.

* * * * *